US007086781B2

(12) United States Patent
Richardson, Jr. et al.

(10) Patent No.: US 7,086,781 B2
(45) Date of Patent: Aug. 8, 2006

(54) BULK BAG FOR MEAT AND MEAT PRODUCTS

(75) Inventors: Joe Ronald Richardson, Jr., Sadler, TX (US); Bradley Matthew Eisenbarth, Sherman, TX (US); Bobby Glenn Brown, Dennison, TX (US)

(73) Assignee: B.A.G. Corp., Dallas, TX (US)

( * ) Notice: Subject to any disclaimer, the term of this patent is extended or adjusted under 35 U.S.C. 154(b) by 469 days.

(21) Appl. No.: 10/689,278

(22) Filed: Oct. 20, 2003

(65) Prior Publication Data

US 2004/0081374 A1 Apr. 29, 2004

Related U.S. Application Data

(63) Continuation-in-part of application No. 10/436,761, filed on May 13, 2003, now Pat. No. 6,921,201, which is a continuation-in-part of application No. 10/253,086, filed on Sep. 24, 2002, now Pat. No. 6,739,753.

(60) Provisional application No. 60/389,865, filed on Jun. 20, 2002, now abandoned.

(51) Int. Cl.
*B65D 30/22* (2006.01)

(52) U.S. Cl. ..... 383/38; 383/33; 383/109; 383/119; 220/9.4

(58) Field of Classification Search ..... 383/38, 383/109, 33, 119; 220/9.1–9.4
See application file for complete search history.

(56) References Cited

U.S. PATENT DOCUMENTS

| | | | | |
|---|---|---|---|---|
| 3,105,617 | A | 10/1963 | Felldin | |
| 3,961,655 | A | 6/1976 | Nattrass et al. | |
| 4,597,102 | A | 6/1986 | Nattrass | |
| 4,781,472 | A | 11/1988 | LaFleur et al. | |
| 4,901,885 | A | 2/1990 | Boots | |
| 4,927,037 | A * | 5/1990 | Boots | 220/1.5 |
| 5,025,925 | A | 6/1991 | Wiklund | |
| 5,052,579 | A * | 10/1991 | Boots | 220/668 |
| 5,289,937 | A | 3/1994 | Boots | |
| 5,323,922 | A | 6/1994 | Lapoint et al. | |
| 5,423,611 | A | 6/1995 | Sherrard | |
| 5,762,421 | A | 6/1998 | Ross | |
| 6,015,057 | A | 1/2000 | Stone et al. | |
| 6,056,440 | A | 5/2000 | Nattrass | |
| 6,203,198 | B1 | 3/2001 | Stone | |
| 6,220,755 | B1 | 4/2001 | Brown et al. | |
| 6,224,260 | B1 | 5/2001 | Nickell et al. | |
| 6,244,443 | B1 | 6/2001 | Nickell et al. | |
| 6,415,927 | B1 | 7/2002 | Stone et al. | |
| 6,739,753 | B1 * | 5/2004 | Richardson et al. | 383/16 |
| 6,921,201 | B1 * | 7/2005 | Richardson et al. | 383/16 |
| 2001/0000712 | A1 | 5/2001 | Nickell et al. | |
| 2001/0004058 | A1 | 6/2001 | Nickell et al. | |
| 2001/0041023 | A1 | 11/2001 | Brown et al. | |
| 2002/0008517 | A1 | 1/2002 | Derby et al. | |

(Continued)

FOREIGN PATENT DOCUMENTS

| | | |
|---|---|---|
| CA | 2416049 | 12/2003 |

(Continued)

*Primary Examiner*—Jes F. Pascua
(74) *Attorney, Agent, or Firm*—Michael A. O'Neil

(57) ABSTRACT

A bulk bag comprises side wall panels formed from woven polypropylene fabric and arranged in a rectangular configuration. A long, narrow, strip of polypropylene fabric is sewn to the side wall panels at each of the corners to define a pocket which receives a support member. A frame having a rectangular configuration congruent with the shape of the bulk bag has legs depending therefrom which are received in the pockets to secure the bulk bag in an open configuration.

8 Claims, 4 Drawing Sheets

U.S. PATENT DOCUMENTS

| | | | |
|---|---|---|---|
| 2002/0170844 | A1 | 11/2002 | Stone et al. |
| 2003/0235349 | A1 | 12/2003 | Richardson, Jr. et al. |
| 2003/0235350 | A1 | 12/2003 | Richardson, Jr. et al. |
| 2004/0040883 | A1 | 3/2004 | Stone et al. |
| 2004/0081374 | A1 | 4/2004 | Richardson, Jr. et al. |
| 2004/0151404 | A1 | 8/2004 | Richardson, Jr et al. |
| 2004/0184679 | A1 | 9/2004 | Williamson et al. |
| 2004/0264814 | A1 | 12/2004 | Eisenbarth et al. |
| 2005/0063623 | A1 | 3/2005 | Eisenbarth et al. |

FOREIGN PATENT DOCUMENTS

| | | |
|---|---|---|
| CA | 2460758 | 11/2004 |
| DE | 69306268 | 1/1997 |
| EP | 0552845 | 7/1993 |
| EP | 1375387 | 1/2004 |
| EP | 1477428 | 11/2004 |
| FI | 863992 | 3/1988 |
| JP | 7251895 | 10/1995 |
| JP | 2002019879 | 1/2002 |
| NL | 9200130 | 8/1993 |
| WO | WO 89/09171 | 10/1989 |
| WO | WO 01/42098 | 6/2001 |

* cited by examiner

BULK BAG FOR MEAT AND MEAT PRODUCTS

CROSS-REFERENCE TO RELATED APPLICATIONS

This application is a continuation-in-part application of application Ser. No. 10/436,761 filed May 13, 2003, now U.S. Pat. No. 6,921,201, which is a continuation-in-part of application Ser. No. 10/253,086 filed Sep. 24, 2002, now U.S. Pat. No. 6,739,753, which is a utility application comprising a continuation-in-part of prior provisional application Ser. No. 60/389,865 filed Jun. 20, 2002, abandoned.

TECHNICAL FIELD

This invention relates generally to bulk bags, and more particularly to a bulk bag construction that is particularly adapted for use in conjunction with meat and meat products.

BACKGROUND AND SUMMARY OF THE INVENTION

Heretofore meat and meat products have been transported in large cardboard boxes which are mounted on wooden pallets. As is well known, both cardboard and wood can and do harbor microorganisms, insects, etc. The presence of such organisms in and around containers utilized to receive, store, transport, and discharge meat and meat products can lead to contamination thereof. Total freedom from contamination is an absolute necessity in the food industry. Therefore, a need exists for a container adapted to receive, store, transport and discharge meat and meat products which is incapable of harboring contaminating organisms.

Pending U.S. application patent application Ser. No. 10/436,761, which is assigned to the assignee hereof, discloses a bulk bag in which the fabric of the side wall panels comprising the bulk bag is formed into four vertically extending pockets. The pockets receive supporting members formed from PVC pipe or similar materials. The function of the supporting members is to maintain the bulk bag in an upright configuration thereby facilitating the receipt of meat and meat products therein.

The present invention comprises an improvement over the bulk bag construction disclosed and claimed in the above-identified co-pending application. In accordance with the present invention, vertically extending pockets are provided at the corners of the bulk bag by sewing long, narrow fabric strips to the fabric comprising the side wall panels of the bulk bag. The pockets receive supporting members formed from PVC pipe or similar materials which function to maintain the bulk bag in an upright configuration. The pockets also receive legs depending from a frame which secures the bulk bag in an open configuration during the filling of the bulk bag with meat and meat products.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
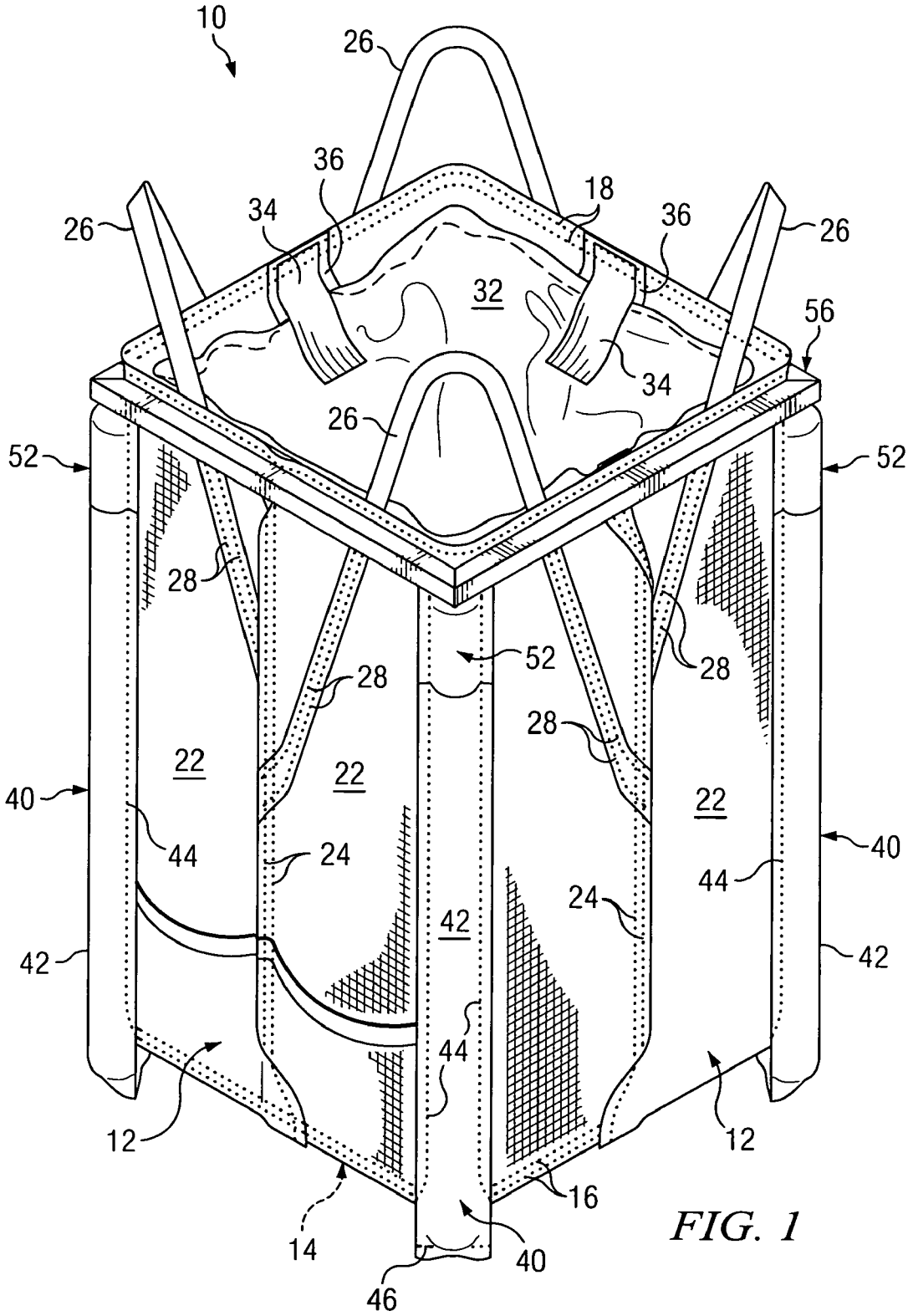
FIG. 1 is a perspective view of a bulk bag constructed in accordance with the present invention.

Referring now to the Drawings, and particularly to FIG. 1 thereof, there is shown a bulk bag 10 incorporating the present invention. The bulk bag 10 comprises four side walls 12 and a bottom wall 14 which is secured to the lower ends of the side walls 12 by sew lines 16. The upper ends of the side walls 12 are folded over and secured by sew lines 18 to provide reinforced upper edges.

In the drawings the side walls 12 are shown arranged in a geometrical configuration comprising a square, however, it will be understood that the side walls can be arranged in other geometrical configurations depending upon the requirements of particular applications of the invention. Similarly, the bulk bag 10 as shown comprises four corners located at the intersections of the side walls 12. However, the exact number of corners comprising the bulk bag 10 may be more or less than four depending upon the geographical configuration defined by the side walls 12.

The side walls 12 comprise four side wall panels 22 which are secured together end-to-end by sew lines 24. The side wall panels 22 are preferably manufactured from woven polypropylene fabric although other materials may be utilized in the construction of the bulk bag 10, if desired. As will be evident from the drawings, the side wall panels 22 extend around the corners defined by the side walls 12.

The bulk bag 10 further comprises four lift loops 26 which are formed from webbing of the type utilized in the manufacture of automotive and aircraft seatbelts and in similar applications. The lift loops are secured to the side wall panels 22 by sew lines 28 and are further secured by the sew lines 24 which define the side wall seams.

The bulk bag 10 further comprises a liner 32 which may be formed from polyethylene film. Other types of plastic film may also be used in the manufacture of the liner 32 depending upon particular applications of the invention. The liner 32 is secured within the interior of the bulk bag 10 by lengths of fiber reinforced plastic tape 34 which are adhesively secured to the film comprising the liner 32. The lengths of tape 34 are in turn secured to the side walls 12 of the bulk bag 10 by the sew lines 18. Small sections of woven polypropylene fabric 36 are utilized to prevent the lengths of tape 34 from tearing loose from the side walls 12 of the bulk bag 10.

For purposes of clarity, the lengths of fiber reinforced plastic tape 34 and the sections of woven polypropylene fabric 36 which are used to secure the liner 32 to the side walls 12 of the bulk bag 10 are shown positioned at the centers of the side walls 12. In actual practice, however, the lengths of tape 34 and the sections of woven polypropylene fabric 36 which are utilized to secure the liner 32 to the side walls 12 of the bulk bag 10 are preferably located at the corners of the side walls.

Figure 2:
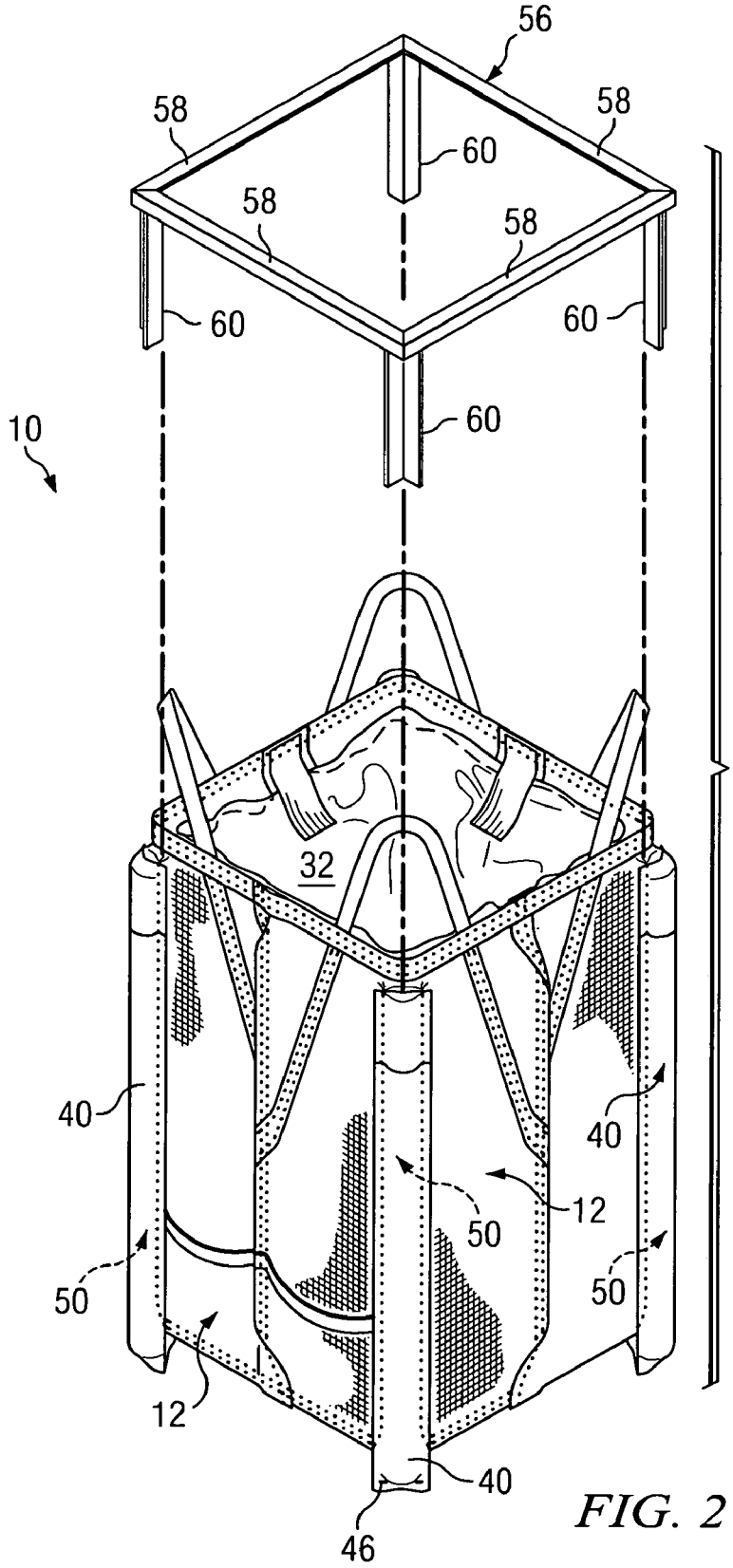
FIG. 2 is an exploded perspective view illustrating the use of a frame in conjunction with the bulk bag of FIG. 1.
Figure 4:
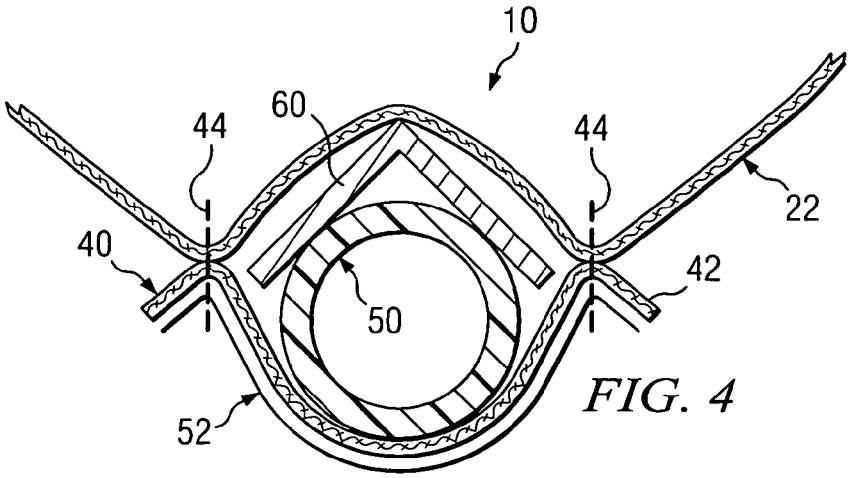
FIG. 4 is a sectional view taken along the line 4—4 in FIG. 3 in the direction of the arrows.
Figure 5:
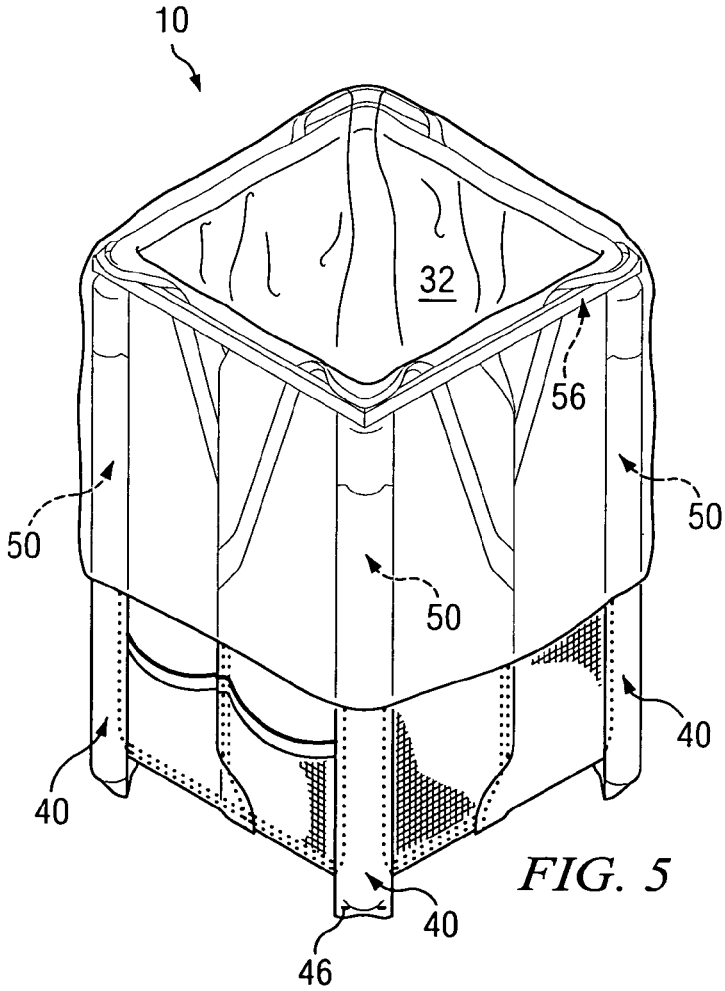
FIG. 5 is a perspective view showing the bulk bag of FIG. 1 ready for filling with meat and meat products.

In accordance with the present invention, the bulk bag 10 is provided with support member receiving pockets 40 which are located at the corners of the side walls 12, respectively. Referring particularly to FIG. 4, each side wall pocket 40 comprises a long, narrow strip of woven polypropylene fabric 42 which is secured to the fabric comprising one of the side wall panels 22 by sew lines 44 extending parallel to the corners of the bulk bag. As will be appreciated by those skilled in the art, other types and kinds of fabrics and/or films may be utilized in the construction of the pockets 40 depending upon the requirements of particular applications of the invention. Referring momentarily to FIGS. 1, 2 and 5, the lower end of each pocket 40 is permanently closed by a sew line 46.

Figure 3:
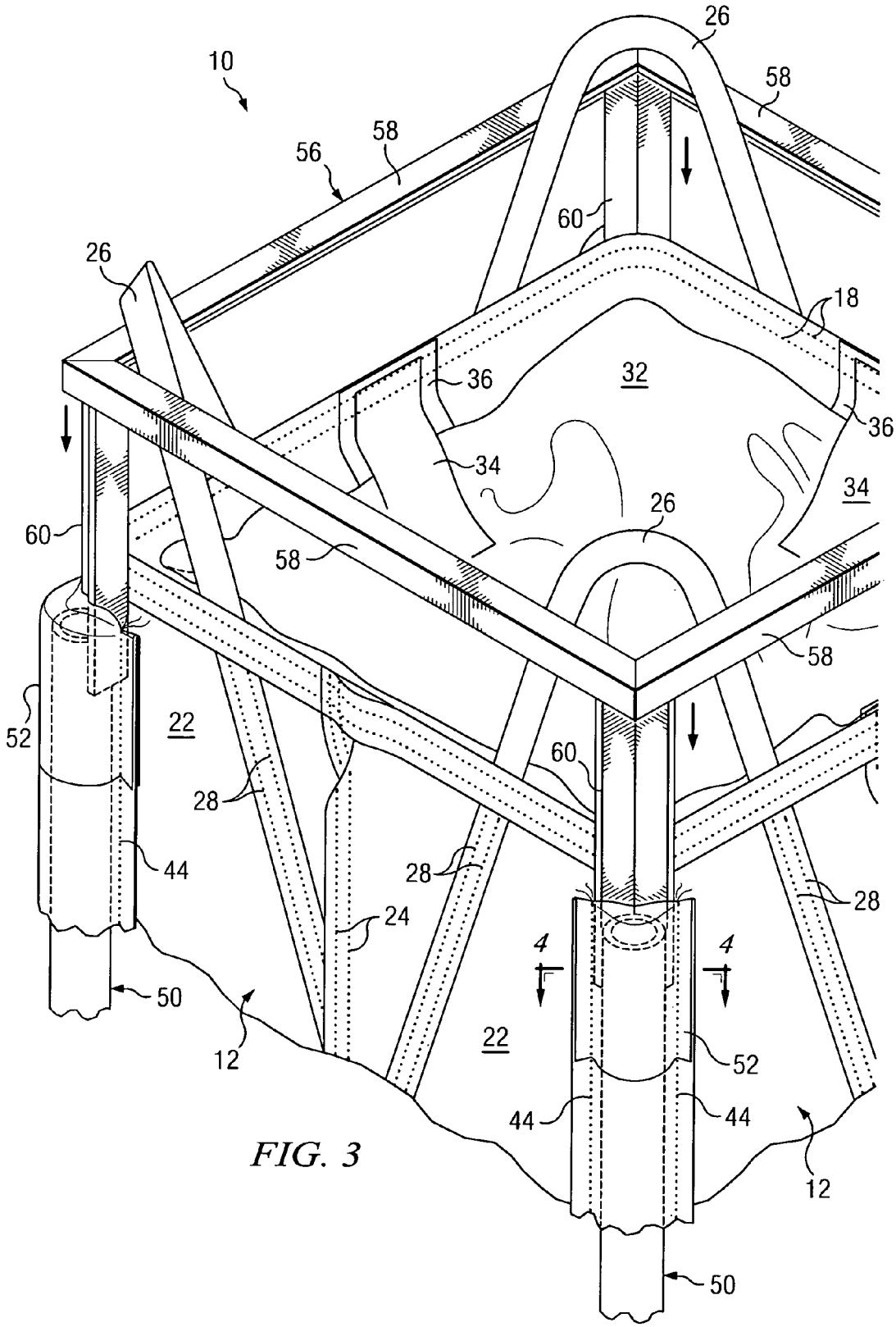
FIG. 3 is a partial perspective view illustrating the bulk bag of FIG. 1 and the use of the frame in conjunction therewith.

As is best shown in FIGS. 3 and 4, each pocket 40 receives a support member 50 which extends substantially the entire length of the pocket. The support member 50 may be formed from PVC pipe, however, other types of plastic pipe, pipe formed from other materials including metals, and solid rods formed from plastics, wood, and other materials may also be utilized in the manufacture of the support members 50. Each support member 50 is permanently retained in its respective pocket 40 by a cover 52 which is secured to the fabric of the side wall panels 22 by the sew lines 44. However, as will become more apparent hereinafter, the upper, inner edge of each cover 52 is open and unsecured.

The function of the support members 50 is to maintain the bulk bag 10 in an upright configuration, that is, to prevent the side walls 12 thereof from collapsing downwardly toward the bottom wall 14. In accordance with the present invention there is also provided a frame 56 the function of which is to prevent the side walls 12 of the bulk bag 10 from collapsing inwardly toward one another. Thus, the frame 56 functions to maintain the bulk bag 10 in a fully open configuration during filling thereof. The frame 56 may be formed from lengths of angle iron formed from steel or any other strong, durable material. The frame 56 may also comprise members having cross-sectional configurations different from the angle iron configuration.

The frame 56 comprises top members 58 which are joined end-to-end and which define a geometrical configuration which is congruent with the geometrical configuration defined by the side walls 12. The frame 56 further comprises legs 60 which extend downwardly from the top members 58. When the angle iron configuration is utilized in the manufacture of the legs 60, the concave sides of the angle irons face outwardly.

As is best shown in FIGS. 2, 3, and 4, the legs 60 of the frame 56 are received in the pockets 40 which also have the support members 50 retained therein. The legs 60 enter the pockets 40 on the interior side thereof relative to the positioning of the support members 50. The legs 60 are extended into the pockets 40 until the top members 58 of the frame engage the upper ends of the side walls 12 comprising the bulk bag 10.

After the legs 60 of the frame 56 are fully seated in the pockets 40 and the top members 58 of the frame 56 are engaged with the upper ends of the side walls 12 of the bulk bag 10, the open end of the liner 32 is pulled out of the interior of the bulk bag 10 and is draped over the upper portions of the exterior surfaces of the side walls 12 of the bulk bag 10 in the manner illustrated in FIG. 5. At this point the bulk bag 10 is fully prepared for the receipt of meat and meat products there within.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A bulk bag comprising:

side walls having upper and lower ends and defining a predetermined geometrical configuration having a plurality of corners;

the side walls comprising fabric side wall panels connected end-to-end with each of the side wall panels extending around one of the corners of the bulk bag;

a bottom wall secured to the lower ends of the side walls;

the side walls and the bottom wall defining the interior of the bulk bag;

a liner secured within the interior of the bulk bag as defined by the side walls and the bottom wall;

a plurality of pockets each located at one of the corners of the bulk bag;

each of the pockets comprising a long, narrow fabric strip secured to the fabric comprising the side wall panels by sew lines extending parallel to the corners of the bulk bag;

a plurality of support members each received within one of the pockets and extending substantially the entire length thereof for retaining the bulk bag in an upright configuration;

a frame comprising a plurality of top members defining a geometrical configuration which is congruent with the geometrical configuration defined by the side walls and a plurality of legs depending from the top members at the corners thereof; and the legs of the frame being received within the pockets of the bulk bag to retain the bulk bag in an open configuration.

2. The bulk bag according to claim 1 wherein the side walls define a square configuration.

3. The bulk bag according to claim 1 wherein side wall panels are formed from woven polypropylene fabric.

4. The bulk bag according to claim 1 wherein the liner is formed from polyethylene film.

5. The bulk bag according to claim 1 wherein the side wall panels are formed from woven polypropylene fabric and wherein the pockets are formed from long, narrow strips comprising woven polypropylene fabric.

6. The bulk bag according to claim 1 wherein the support members are formed from PVC pipe.

7. The bulk bag according to claim 1 wherein the top members and the legs of the frame are formed from lengths of angle iron.

8. A bulk bag comprising:

four side walls having upper and lower ends defining a rectangular configuration having four corners;

the side walls comprising woven polypropylene fabric side wall panels connecting end-to-end with each of the side wall panels extending around one of the corners of the bulk bag;

a bottom wall secured to the lower ends of the side wall;

the side walls and the bottom wall defining the interior of the bulk bag;

a liner formed from polyethylene film secured within the interior of the bulk bag as defined by the side walls and the bottom walls;

pockets each located at one of the corners of the bulk bag;

each of the pockets comprising a long, narrow woven polypropylene fabric strip secured to the woven polypropylene fabric comprising the side wall panels by sew lines extending parallel to the corners of the bulk bag;

four support members each formed from PVC pipe and each received within one of the pockets defined by the side walls and extending substantially the entire length thereof for retaining the bulk bag in an upright configuration;

a frame comprising top members formed from angle iron arranged in a rectangular configuration congruent with the rectangular configuration defined by the side walls and legs each formed from angle iron and depending from the top members at the corners thereof; and the legs being received within the pockets of the bulk bag and the top members engaging the upper ends of the side walls to retain the bulk bag in an open configuration.

* * * * *